US009279303B2

(12) United States Patent
Hales et al.

(10) Patent No.: US 9,279,303 B2
(45) Date of Patent: Mar. 8, 2016

(54) SECONDARY BARRIER FOR USE IN CONJUNCTION WITH AN ISOLATION DEVICE IN A HORIZONTAL WELLBORE

(71) Applicant: HALLIBURTON ENERGY SERVICES, INC, Houston, TX (US)

(72) Inventors: John H. Hales, Oklahoma City, OK (US); Shawn R. Webb, Oklahoma City, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 563 days.

(21) Appl. No.: 13/653,156

(22) Filed: Oct. 16, 2012

(65) Prior Publication Data

US 2014/0102724 A1 Apr. 17, 2014

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

| | | | | |
|---|---|---|---|---|
| 7,841,417 | B2 * | 11/2010 | Allison et al. | 166/387 |
| 2007/0221387 | A1 * | 9/2007 | Levy | 166/387 |
| 2008/0185158 | A1 * | 8/2008 | Chalker et al. | 166/387 |
| 2009/0065195 | A1 * | 3/2009 | Chalker et al. | 166/183 |
| 2011/0067889 | A1 * | 3/2011 | Marya et al. | 166/386 |
| 2011/0203793 | A1 * | 8/2011 | Tibbles | 166/278 |
| 2013/0062073 | A1 * | 3/2013 | Landsiedel | 166/378 |

* cited by examiner

*Primary Examiner* — Nicole Coy
(74) *Attorney, Agent, or Firm* — McGuire Woods, LLP

(57) ABSTRACT

A secondary barrier for use in conjunction with an isolation device in a portion of a non-vertical wellbore comprises: a swellable material, wherein the swellable material: (A) has dimensions such that, prior to swelling, the secondary barrier is capable of being placed into the portion of the non-vertical wellbore, and (B) fills a void within the portion of the non-vertical wellbore, wherein the swellable material fills the void after the swelling of at least a portion of the swellable material has occurred, wherein the secondary barrier is positioned adjacent to the isolation device in the portion of the non-vertical wellbore. A method of creating a secondary barrier comprises: introducing the secondary barrier into the portion of the non-vertical wellbore; and contacting or allowing the swellable material to come in contact with the swelling fluid or the increase in temperature.

17 Claims, 2 Drawing Sheets

SECONDARY BARRIER FOR USE IN CONJUNCTION WITH AN ISOLATION DEVICE IN A HORIZONTAL WELLBORE

TECHNICAL FIELD

A secondary barrier for use in conjunction with an isolation device in a non-vertical wellbore, for example a horizontal wellbore portion, and methods of use are provided. The secondary barrier can include an enclosure and a cement composition. The secondary barrier can also include a swellable material. The secondary barrier can form a seal in the non-vertical wellbore, thus restricting or preventing fluid flow across the secondary barrier and the isolation device.

SUMMARY

According to an embodiment, a secondary barrier for use in conjunction with an isolation device in a portion of a non-vertical wellbore comprises: an enclosure, wherein the dimensions of the enclosure are selected such that the secondary barrier is capable of being placed into the portion of the non-vertical wellbore, and a cement composition, wherein the cement composition: (A) is contained within the enclosure for a specified period of time; and (B) fills a void within the portion of the non-vertical wellbore, wherein the secondary barrier is positioned adjacent to the isolation device in the portion of the non-vertical wellbore.

According to another embodiment, a method of creating a secondary barrier adjacent to an isolation device in a portion of a non-vertical wellbore comprises: introducing the secondary barrier into the portion of the non-vertical wellbore, wherein the secondary barrier comprises: (A) an enclosure, wherein the dimensions of the enclosure are selected such that the secondary barrier is capable of being placed into the portion of the non-vertical wellbore, and (B) a cement composition, wherein the cement composition: (i) is contained within the enclosure for a specified period of time; and (ii) fills a void within the portion of the non-vertical wellbore, wherein the secondary barrier is positioned adjacent to the isolation device in the portion of the non-vertical wellbore; and allowing or causing the cement composition to set, wherein the step of allowing or causing the cement composition to set is performed after the step of introducing the secondary barrier into the portion of the non-vertical wellbore.

According to another embodiment, a secondary barrier for use in conjunction with an isolation device in a portion of a non-vertical wellbore comprises: a swellable material, wherein the swellable material: (A) has dimensions such that, prior to swelling, the secondary barrier is capable of being placed into the portion of the non-vertical wellbore, and (B) fills a void within the portion of the non-vertical wellbore, wherein the swellable material fills the void after the swelling of at least a portion of the swellable material has occurred, wherein the secondary barrier is positioned adjacent to the isolation device in the portion of the non-vertical wellbore.

According to another embodiment, a method of creating a secondary barrier adjacent to an isolation device in a portion of a non-vertical wellbore comprises: introducing the secondary barrier into the portion of the non-vertical wellbore, wherein the secondary barrier comprises: a swellable material, wherein the swellable material: (A) swells in the presence of a swelling fluid or an increase in temperature, (B) has dimensions such that, prior to swelling, the secondary barrier is capable of being placed into the portion of the non-vertical wellbore, and (C) fills a void within the portion of the non-vertical wellbore, wherein the swellable material fills the void after the swelling of at least a portion of the swellable material has occurred, wherein the secondary barrier is positioned adjacent to the isolation device in the portion of the non-vertical wellbore; and contacting or allowing the swellable material to come in contact with the swelling fluid or the increase in temperature, wherein the step of contacting or allowing is performed after the step of introducing the secondary barrier into the portion of the non-vertical wellbore.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
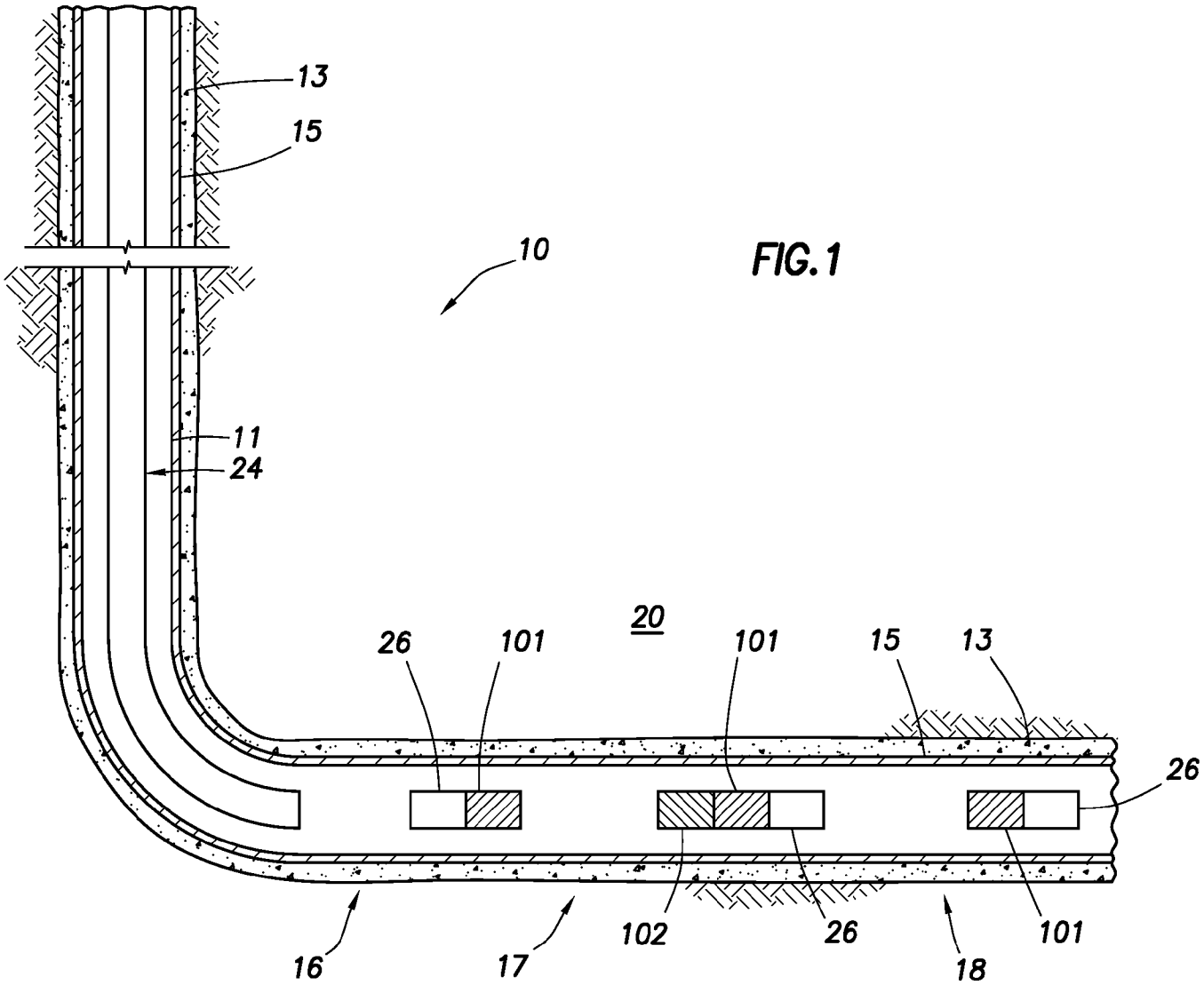
FIG. 1 depicts a well system containing isolation devices and secondary barriers according to certain embodiments.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more isolation devices, zones, secondary barriers, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A solution is an example of a homogenous fluid, containing a solvent (e.g., water) and a solute. A colloid is an example of a heterogeneous fluid. A colloid can be: a slurry, which includes an external liquid phase and undissolved solid particles as the internal phase; an emulsion, which includes an external liquid phase and at least one internal phase of immiscible liquid droplets; a foam, which includes an external liquid phase and a gas as the internal phase; or a mist, which includes an external gas phase and liquid droplets as the internal phase. There can be more than one internal phase of a colloid, but only one external phase. For example, there can be an external phase which is adjacent to a first internal phase, and the first internal phase can be adjacent to a second internal phase. Any of the phases of a colloid can contain dissolved materials and/or undissolved solids.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and non-vertical portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore. A cased-hole wellbore portion can also contain cement in the annulus between the wall of the wellbore and the outside of the casing.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. One or more zones of the formation can be isolated within the wellbore via the use of an isolation device. An isolation device can be used for zonal isolation and functions to block fluid flow within a tubular, such as a casing, or within an annulus. The blockage of fluid flow prevents the fluid from flowing across the isolation device in any direction (either downstream or upstream) and isolates the zone of interest. As used herein, the relative term "downstream" means at a location further away from a wellhead. As used herein, the relative term "upstream" means at a location closer to the wellhead. In this manner, treatment techniques can be performed within the zone of interest.

Common isolation devices include, but are not limited to, retainer, a ball and a seat, a bridge plug, a packer, a plug, and wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished by introducing the isolation device into the desired portion of the wellbore. The isolation device can include a sealing element. For example, a bridge plug is composed primarily of slips, a plug mandrel, a setting device, and a rubber sealing element, and a packer generally consists of a sealing device, a holding or setting device, and an inside passage for fluids. The outer diameter (O.D.) of the isolation device can be caused to expand, wherein after expansion, the O.D. of the isolation device engages with the inside wall of the tubular or annulus. By engaging with the inside wall, the isolation device functions to block fluid flow across the expanded isolation device. Zonal isolation can also be accomplished, for example, via a ball and seat by dropping the ball from the wellhead onto the seat that is located within the wellbore. The ball engages with the seat, and the seal created by this engagement prevents fluid communication into other zones downstream of the ball and seat.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device or the entire device. Yet, another way to remove an isolation device is to contact the device with a solvent, such as an acid, thus dissolving all or a portion of the device.

Often times the seal created by an isolation device is not capable of prolonged use in a well. The sealing mechanism may no longer function over extended periods of time, and as a result fluid isolation can be compromised. Therefore, when an isolation device is to be used for an extended period of time, typically greater than 30 days, a secondary barrier is often used in conjunction with the isolation device.

A commonly-used secondary barrier is a cement composition. As used herein, a "cement composition" is a mixture of at least cement and water. A cement composition can include additives. As used herein, the term "cement" means an initially dry substance that develops compressive strength or sets in the presence of water. An example of cement is Portland cement. A cement composition is generally a slurry in which the water is the continuous phase of the slurry and the cement (and any other insoluble particles) is the dispersed phase. The continuous phase of a cement composition can include dissolved solids. Another common secondary barrier is a swellable material. As used herein, the term "swellable" and all grammatical variations thereof, means capable of swelling and having an increase in volume. For example, a swellable material can swell in the presence of a liquid and the material can expand, thereby achieving an increase in volume of the material. A swellable material can also swell in the presence of an increase in temperature, or could also be activated to swell in the presence of a fluid or increase in temperature via a mechanical means, such as an impact.

However, the use of a secondary barrier in a non-vertical wellbore has proven to be quite challenging. As used herein, the term "non-vertical wellbore" means the portion of a wellbore that is not perpendicular to the earth's surface. For example, non-vertical wellbore portions include, but are not limited to, highly deviated, tangents that are highly deviated, horizontal sections, or portions that turn up-dip (i.e., the wellbore goes from a downward substantially vertical orientation to horizontal and then to an upward substantially vertical orientation). It is to be understood that a wellbore can include both vertical sections and also non-vertical sections. The vertical section would be the portion of the wellbore that is substantially perpendicular to the earth's surface. It is to also be understood that a non-vertical wellbore can include angled, curved, and/or straight sections.

Due to the non-vertical nature of these wellbore portions, a fluid that is introduced into the non-vertical wellbore will tend to settle to the bottom of the wellbore due to force of gravity.

As used herein, the term "bottom" means at a location farther away from the earth's surface. Because the fluid settles to the bottom, gaps can exist between the secondary barrier and the upper and possibly the middle portions of the inside of the casing or wall of the annulus. Consequently, the secondary barrier does not create a seal in these situations, and the effectiveness of the secondary barrier is diminished or eliminated.

Therefore, a need exists for a secondary barrier that can be used in conjunction with an isolation device in non-vertical wellbores. The secondary barrier needs to be capable of forming a complete seal in the non-vertical wellbore.

A novel secondary barrier comprising a swellable material can be introduced into the non-vertical wellbore. According to another embodiment, the secondary barrier can be a cement composition and included in a carrier that is introduced into the non-vertical wellbore.

According to a first embodiment, a secondary barrier for use in conjunction with an isolation device in a portion of a non-vertical wellbore comprises: an enclosure, wherein the dimensions of the enclosure are selected such that the secondary barrier is capable of being placed into the portion of the non-vertical wellbore, and a cement composition, wherein the cement composition: (A) is contained within the enclosure for a specified period of time; and (B) fills a void within the portion of the non-vertical wellbore, wherein the secondary barrier is positioned adjacent to the isolation device in the portion of the non-vertical wellbore.

According to a second embodiment, a secondary barrier for use in conjunction with an isolation device in a portion of a non-vertical wellbore comprises: a swellable material, wherein the swellable material: (A) has dimensions such that, prior to swelling, the secondary barrier is capable of being placed into the portion of the non-vertical wellbore, and (B) fills a void within the portion of the non-vertical wellbore, wherein the swellable material fills the void after the swelling of at least a portion of the swellable material has occurred, wherein the secondary barrier is positioned adjacent to the isolation device in the portion of the non-vertical wellbore.

Any discussion of the embodiments regarding the secondary barrier and the isolation device or any component thereof (e.g., the enclosure) is intended to apply to all of the apparatus and method embodiments. Any discussion of a particular component of an embodiment (e.g., a secondary barrier) is meant to include the singular form of the component and also the plural form of the component, without the need to continually refer to the component in both the singular and plural form throughout. For example, if a discussion involves "the secondary barrier 101," it is to be understood that the discussion pertains to one barrier (singular) and two or more barriers (plural).

Turning to the Figures, FIG. 1 depicts a well system 10. The well system 10 can include at least one wellbore 11. The wellbore 11 includes at least one non-vertical portion of the wellbore 11. The wellbore 11 can also include a vertical wellbore section. The portion of the non-vertical wellbore 11 can penetrate a subterranean formation 20. The subterranean formation 20 can be a portion of a reservoir or adjacent to a reservoir. The wellbore 11 can include a casing 15. A first tubing string 24 can be installed in the wellbore 11. Multiple other tubing strings (not shown) can also be installed in the wellbore 11. The well system 10 can comprise at least a first zone 16 and a second zone 17. The well system 10 can also include more than two zones, for example, the well system 10 can further include a third zone 18, a fourth zone, and so on.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing.

The well system 10 includes an isolation device 26. The isolation device 26 can be positioned in the portion of the non-vertical wellbore 11. The isolation device 26 can isolate two zones of the portion of the non-vertical wellbore 11. For example, and as can be seen in FIG. 1, the isolation device 26 can isolate the first zone 16 from the second zone 17. The well system 10 can also include two or more isolation devices 26. A first isolation device 26 can be used to isolate two zones while a second isolation device 26 can be used to isolate two zones. As depicted, for example, a first isolation device 26 can isolate the first zone 16 and the second zone 17, while a second isolation device 26 can isolate the second zone 17 and a third zone 18. Of course there can be multiple isolation devices 26 that isolate multiple zones in the portion of the non-vertical wellbore 11. The isolation device 26 can be positioned within the portion of the non-vertical wellbore 11 via a variety of deployment mechanisms, for example, a wireline, tubing string, or autonomous methods. The portion of the non-vertical wellbore 11 can be an open-hole portion or a cased-hole portion. Of course, a first isolation device 26 can be positioned in an open-hole portion of the non-vertical wellbore 11 and a second isolation device 26 can be positioned in a cased-hole portion of the non-vertical wellbore 11. The isolation device 26 can also be positioned inside the inner diameter (I.D.) of a tubing string or in an annulus.

According to an embodiment, the isolation device 26 restricts or prevents fluid flow across the isolation device. Examples of isolation devices capable of restricting or preventing fluid flow across the device include, but are not limited to, a ball and seat, a plug, a bridge plug, a wiper plug, and a packer. According to another embodiment, the isolation device 26 restricts or prevents fluid flow between two zones. According to another embodiment, the isolation device 26 restricts or prevents fluid flow across the isolation device for a time period of less than 30 days.

The isolation device 26 can be comprised of a variety of materials. Examples of suitable materials include, but are not limited to, metals, metal alloys, plastics, and thermoplastics. The isolation device 26 can also be a variety of shapes and sizes.

The well system 10 also includes the secondary barrier 101. The secondary barrier 101 is positioned adjacent to the isolation device 26 in the portion of the non-vertical wellbore 11. As can be seen in FIG. 1, the well system 10 can include two or more secondary barriers 101. For example, there can be a first secondary barrier 101 and a second secondary barrier 102. According to this embodiment, the first secondary barrier 101 can be positioned adjacent to the isolation device 26, while the second secondary barrier 102 can be positioned adjacent to the first secondary barrier 101. In this manner, in the event the first or second secondary barriers 101/102 should no longer function to restrict or prevent fluid flow, then the other secondary barrier can effectively function to restrict or prevent fluid flow. As can also be seen in the Figures, the secondary barrier 101 can be located upstream or downstream of the isolation device 26. In this manner, depending on the direction of fluid flow in the portion of the non-vertical wellbore 11, the secondary barrier 101 can help prevent or restrict fluid flow across the isolation device 26.

The secondary barrier 101 can restrict or prevent fluid flow across the secondary barrier 101. According to a first embodiment, the secondary barrier 101 comprises an enclosure and a cement composition. The dimensions of the enclosure are selected such that the secondary barrier 101 is capable of being placed, or is placed, into the portion of the non-vertical wellbore 11. The enclosure can be a variety of shapes. The shape of the enclosure can be selected from the group consisting of spherical, oblique, tubular, and polygonal. The enclosure can have a largest dimension, for example, a width, base, height, or diameter, that is equal to or less than the sufficient value such that the enclosure is capable of being placed, or is placed, into the portion of the non-vertical wellbore 11.

The enclosure can be made from a variety of materials. The material can be selected from the group consisting of natural or synthetic fabrics, cellulose-based materials (e.g., cardboard), metals, metal alloys, plastics (including thermoplastics), peak, ceramics, and combinations thereof in any proportion. According to an embodiment, the enclosure is made from a deformable material. As used herein, the term "deformable" means the material is capable of having its shape altered due to an application of a stress and substantially return to its original shape after the stress is no longer applied. By way of example, the enclosure can be spherical in shape. During placement of the enclosure, a stress from a tubing string for example, can deform the enclosure into a relatively tubular shape. The enclosure can then be positioned in an area of the wellbore having a larger I.D. than the I.D. of the casing. Therefore, the stress from the casing is no longer being applied to the material, and the enclosure can then substantially return to its original, spherical shape in order to fill the open-hole portion of the wellbore. It is to be understood that not every outer surface of the enclosure needs to be deformed, nor does the enclosure have to return to the exact same dimensions as the original shape. The thickness of the enclosure can also be selected such that the enclosure is capable of being placed, or is placed, into the portion of the non-vertical wellbore 11 and/or the material is deformable.

According to an embodiment, the material of the enclosure is selected such that the material does not disintegrate before, during, and after placement of the enclosure. Preferably, the material does not disintegrate after being contacted with wellbore fluids. In this manner, the enclosure can remain intact for a desired period of time.

Figure 2:
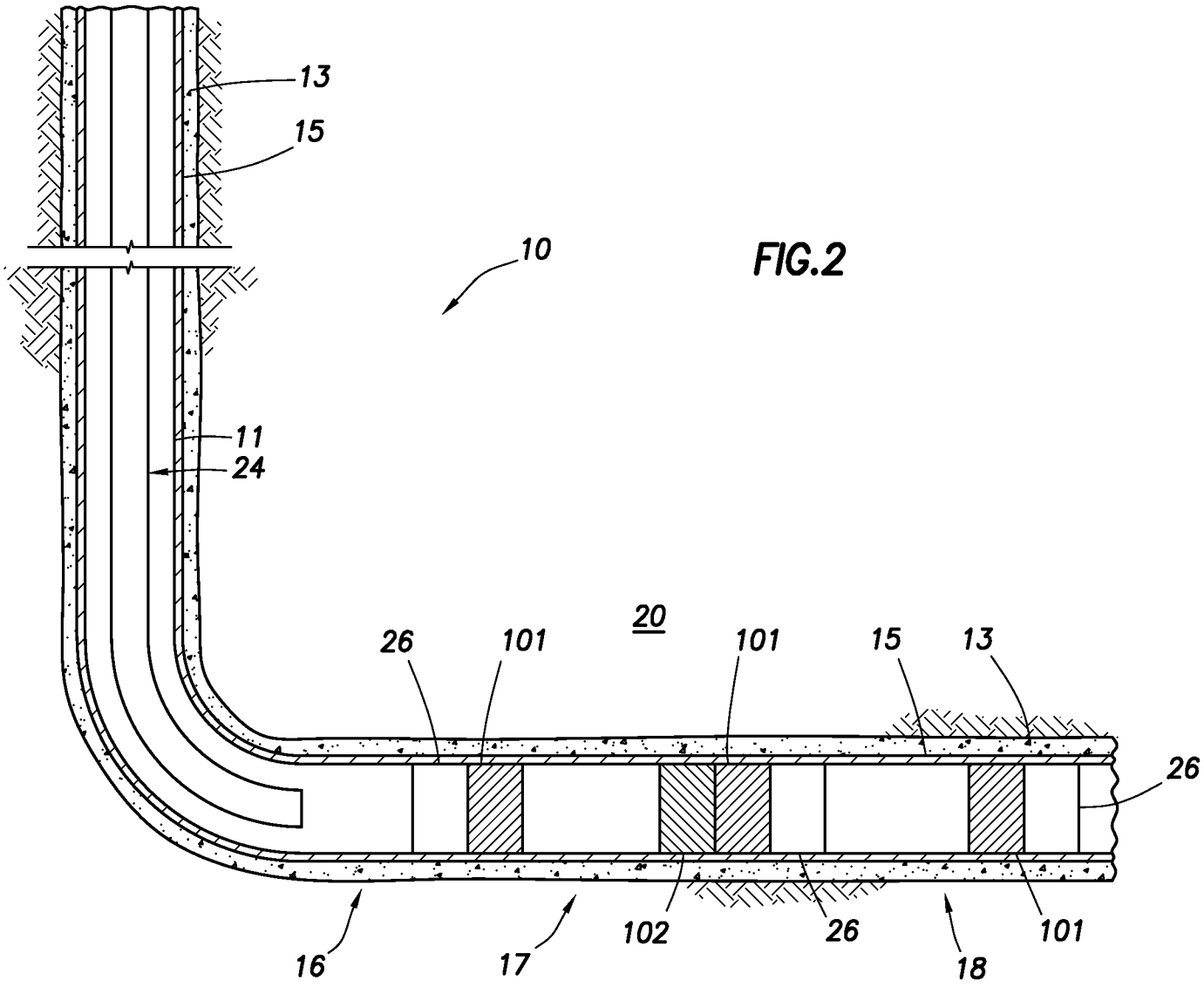
FIG. 2 depicts the well system containing the isolation devices and secondary barriers according to certain embodiments, wherein the secondary barrier has created a seal in a non-vertical wellbore.

Preferably, the dimensions of the enclosure and the material are selected such that after the secondary barrier 101 is positioned adjacent to the isolation device 26 in the portion of the non-vertical wellbore 11, the enclosure has an outer diameter (O.D.) that contacts the entire I.D. of the portion of the non-vertical wellbore 11. According to an embodiment, as depicted in FIG. 2, the cement composition fills the void of the portion of the non-vertical wellbore 11 after the secondary barrier 101 is positioned in the wellbore. For example, if the portion of the non-vertical wellbore 11 is an open-hole portion, then the O.D. of the enclosure contacts the entire I.D. of the wall of the wellbore. In the case of a cased-hole portion, the O.D. of the enclosure contacts the entire I.D. of the casing. In the case of an annulus, the O.D. of the enclosure contacts the entire O.D. of the tubing string and the entire I.D. of the other tubing string or the wall of the wellbore.

According to the first embodiment, the secondary barrier 101 includes a cement composition, wherein the cement composition is capable of filling a void, or fills a void, within the portion of the non-vertical wellbore 11. As used herein, the term "filling," and all grammatical variations thereof, means to occupy the entirety of the void. As used herein, the term "void" means an empty area or space. In this manner, the cement composition can entirely occupy the void, thus creating a seal in the portion of the non-vertical wellbore 11 whereby fluids are restricted or prevented from flowing across the secondary barrier 101.

The cement composition comprises cement and water. The cement composition can also contain other ingredients. According to an embodiment, the enclosure is made of a material that is non-porous. In this manner, the water of the cement composition is incapable of flowing from the enclosure. According to an embodiment, the cement composition can further comprise a swellable material. The swellable material can be a particulate.

The following discussion pertains to the swellable material and swelling fluids according to all embodiments. The swellable material swells or can swell in the presence of a swelling fluid or an increase in temperature. The swellable material can also be activated to swell in the presence of the swelling fluid or increase in temperature via a mechanical means (e.g., an impact). The swelling fluid can comprise an aqueous liquid or a hydrocarbon liquid. The swelling fluid can be homogenous or heterogeneous. The swellable material can be selected such that the swellable material swells or is capable of swelling in the swelling fluid or increase in temperature. According to an embodiment, the swellable material is a hydrocarbon liquid swellable material, and the material is selected from the group consisting of natural rubbers, nitrile rubbers, hydrogenated nitrile rubber, acrylate butadiene rubbers, polyacrylate rubbers, isoprene rubbers, chloroprene rubbers, butyl rubbers (IIR), brominated butyl rubbers (BIIR), chlorinated butyl rubbers (CIIR), chlorinated polyethylenes (CM/CPE), neoprene rubbers (CR), styrene butadiene copolymer rubbers (SBR), sulphonated polyethylenes (CSM), ethylene acrylate rubbers (EAM/AEM), epichlorohydrin ethylene oxide copolymers (CO, ECO), ethylene-propylene rubbers (EPM and EDPM), ethylene-propylene-diene terpolymer rubbers (EPT), ethylene vinyl acetate copolymer, acrylonitrile butadiene rubbers, hydrogenated acrylonitrile butadiene rubbers (HNBR), fluorosilicone rubbers (FVMQ), silicone rubbers (VMQ), poly 2,2,1-bicyclo heptenes (polynorbornene), alkylstyrenes, and combinations thereof. One example of a suitable swellable elastomer comprises a block copolymer of a styrene butadiene rubber. According to another embodiment, the swellable material is an aqueous liquid swellable material. Some specific examples of suitable water-swellable materials, include, but are not limited to starch-polyacrylate acid graft copolymer and salts thereof, polyethylene oxide polymer, carboxymethyl cellulose type polymers, polyacrylamide, poly(acrylic acid) and salts thereof, poly(acrylic acid-co-acrylamide) and salts thereof, graft-poly(ethylene oxide) of poly(acrylic acid) and salts thereof, poly(2-hydroxyethyl methacrylate), and poly(2-hydroxypropyl methacrylate). Combinations of suitable water-swellable materials may also be used. In certain embodiments, the water-swellable material may be cross-linked and/or lightly cross-linked. Other water-swellable materials, that behave in a similar fashion with respect to aqueous fluids, also may be suitable. The previous lists disclosing suitable swellable materials is by no means an exhaustive list, does not include every suitable swellable material example that could be given, and is not meant to limit the scope of the invention.

If the cement composition further comprises the swellable material, then the material of the enclosure can be an expandable material. At least part of the enclosure can also be capable of tearing via a force. According to these embodiments, as the swellable material swells in the presence of the swelling fluid or temperature, the material can expand and at least part of the enclosure can tear via the force of the increase in volume of the swellable material. In this manner, the enclosure and/or the cement composition fills the void within the portion of the non-vertical wellbore 11 due to the swelling of the swellable material.

The cement composition can be contained within the enclosure for a specified period of time. The period of time can be the time of desired use of the secondary barrier 101. The period of time can also be a time less than the time of desired use of the secondary barrier 101. This aspect may be useful when the cement composition contains the swellable material, in which case, the swelling of the swellable material can cause the enclosure to tear, thus some of the cement composition would no longer be contained within the enclosure.

According to a second embodiment, a secondary barrier for use in conjunction with an isolation device in a portion of a non-vertical wellbore comprises: a swellable material, wherein the swellable material: (A) has dimensions such that, prior to swelling, the secondary barrier is capable of being placed into the portion of the non-vertical wellbore, and (B) fills a void within the portion of the non-vertical wellbore, wherein the swellable material fills the void after the swelling of at least a portion of the swellable material has occurred, wherein the secondary barrier is positioned adjacent to the isolation device in the portion of the non-vertical wellbore.

Certain embodiments pertaining to the swellable material and the swelling fluid is discussed above. According to this second embodiment, the swellable material can be a single piece. The single piece can be in a solid form of the swellable material, or the swellable material can be in a matrix form. The swellable material can be a variety of shapes, including, but not limited to, spherical, oblique, tubular, or polygonal (e.g., a plate, a rectangle, a square, a triangle). If the swellable material is in a matrix form, then the secondary barrier 101 can further comprise a non-swellable substance, wherein the non-swellable substance is contained within the voids of the matrix. If the swellable material is in a matrix form, then preferably, the swellable material is non-permeable, thus fluids are restricted or prevented from flowing through the matrix of the swellable material via the inter-connected pores.

The swellable material can also be in multiple pieces. The multiple pieces can be selected from the group consisting of chunks, bulk particles, mesoscopic particles, nanoparticles, and combinations thereof in any proportion. As used herein, a "bulk particle" is a particle having a particle size in the range of greater than 1 micron to 62.4 microns. As used herein, a "mesoscopic particle" is a particle having a particle size in the range of 1 micron to 0.1 microns. As used herein, a "nanoparticle" is a particle having a particle size of less than 0.1 microns. As used herein, the term "particle size" refers to the volume surface mean diameter ("$D_s$"), which is related to the specific surface area of the particle. The volume surface mean diameter may be defined by the following equation: $D_s=6/(\Phi_s A_w \rho_p)$, where $\Phi_s$=sphericity; $A_w$=specific surface area; and $\rho_p$=particle density. If the swellable material is in the form of multiple pieces, then the swellable material can be contained within an enclosure. Details regarding certain aspects of the enclosure applicable for use with this embodiment are discussed above. The enclosure can also contain a non-swellable substance. The non-swellable substance can be, for example, sand or a binder, such as a grout.

According to the second embodiment, the swellable material has dimensions such that, prior to swelling, the secondary barrier 101 is placed or is capable of being placed into the portion of the non-vertical wellbore 11. Preferably, the swellable material has a largest dimension, for example, a width, base, height, or diameter, that is equal to or less than the sufficient value such that the secondary barrier 101 is placed or is capable of being placed into the portion of the non-vertical wellbore 11.

According to the second embodiment, the swellable material fills or is capable of filling a void within the portion of the non-vertical wellbore 11, wherein the swellable material fills or is capable of filling the void after swelling of at least a portion of the swellable material has occurred. According to an embodiment, as depicted in FIG. 2, the swellable material fills the void of the portion of the non-vertical wellbore 11 after the swellable material has swelled. Preferably, the swellable material swells at least a sufficient amount such that after swelling, the swellable material has an O.D. that contacts the entire I.D. of the portion of the non-vertical wellbore 11. So, for example, if the portion of the non-vertical wellbore 11 is an open-hole portion, then the O.D. of the swellable material contacts the entire I.D. of the wall of the wellbore. In the case of a cased-hole portion, the O.D. of the swellable material contacts the entire I.D. of the casing. In the case of an annulus, the O.D. of the swellable material contacts the entire O.D. of the tubing string and the entire I.D. of the other tubing string or the wall of the wellbore.

According to a third embodiment, a method of creating a secondary barrier adjacent to an isolation device in a portion of a non-vertical wellbore comprises: introducing the secondary barrier into the portion of the non-vertical wellbore, wherein the secondary barrier comprises: (A) an enclosure, wherein the dimensions of the enclosure are selected such that the secondary barrier is capable of being placed into the portion of the non-vertical wellbore, and (B) a cement composition, wherein the cement composition: (i) is contained within the enclosure for a specified period of time; and (ii) fills a void within the portion of the non-vertical wellbore, wherein the secondary barrier is positioned adjacent to the isolation device in the portion of the non-vertical wellbore; and allowing or causing the cement composition to set, wherein the step of allowing or causing the cement composition to set is performed after the step of introducing the secondary barrier into the portion of the non-vertical wellbore.

According to a fourth embodiment, a method of creating a secondary barrier adjacent to an isolation device in a portion of a non-vertical wellbore comprises: introducing the secondary barrier into the portion of the non-vertical wellbore, wherein the secondary barrier comprises: a swellable material, wherein the swellable material: (A) swells in the presence of a swelling fluid or an increase in temperature, (B) has dimensions such that, prior to swelling, the secondary barrier is capable of being placed into the portion of the non-vertical wellbore, and (C) fills a void within the portion of the non-vertical wellbore, wherein the swellable material fills the void after the swelling of at least a portion of the swellable material has occurred, wherein the secondary barrier is positioned adjacent to the isolation device in the portion of the non-vertical wellbore; and contacting or allowing the swellable material to come in contact with the swelling fluid or the increase in temperature, wherein the step of contacting or allowing is performed after the step of introducing the secondary barrier into the portion of the non-vertical wellbore.

The step of contacting can include introducing the swelling fluid or heat (such as a heated fluid) into the portion of the non-vertical wellbore 11. The step of allowing can include allowing the swellable material to come in contact with a swelling fluid or an increase in temperature, such as a reservoir fluid.

It may be desirable to delay contact of the swellable material with the swelling fluid or increase in temperature. The swellable material can further include a coating on the outside of the swellable material. The coating can be a compound, such as a wax, thermoplastic, sugar, salt, or polymer. The coating can be selected such that the coating either dissolves in wellbore fluids or melts at a certain temperature. Upon dissolution or melting, at least a portion of the swellable material is available to come in contact with the swelling fluid or increase in temperature.

The methods include the step of introducing the secondary barrier 101 into the portion of the non-vertical wellbore 11. The methods can further include the step of introducing the isolation device 26 into the portion of the non-vertical wellbore 11. The step of introducing the isolation device 26 can be performed prior to, or after the step of, introducing the secondary barrier 101 (depending on whether the secondary barrier 101 is to be located upstream or downstream of the isolation device 26). The methods can further include the step of causing or allowing the isolation device 26 to create a seal in the portion of the non-vertical wellbore 11, wherein the step of causing or allowing is performed after the step of introducing. The steps of introducing (either the secondary barrier 101 or the isolation device 26) can include the use of a wireline or tubing string or other known methods to those of ordinary skill in the art. More than one isolation device 26 and more than one secondary barrier 101 can also be introduced into multiple portions of the non-vertical wellbore 11.

The methods can further include the step of removing all or a portion of the secondary barrier 101 and/or all or a portion of the isolation device 26, wherein the step of removing is performed after the step of allowing or causing the cement composition to set or after the step of contacting or allowing the swellable material to come in contact with the swelling fluid or increase in temperature. The step of removing can include milling or activating a release mechanism.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A secondary barrier for use in conjunction with an isolation device in a portion of a non-vertical wellbore comprising:

a swellable material, wherein the swellable material:

(A) has dimensions such that, prior to swelling, the secondary barrier is capable of being placed into the portion of the non-vertical wellbore, and (B) fills a void within the portion of the non-vertical wellbore to occlude a complete cross-section of the wellbore after the swelling of at least a portion of the swellable material has occurred, wherein the secondary barrier is positioned adjacent to the isolation device in the portion of the non-vertical wellbore, wherein the swellable material is contained within an enclosure, wherein the enclosure is made from an expandable material, and wherein the enclosure comprises a carrier that is introduced into the non-vertical wellbore, the carrier comprising the swellable material.

2. The secondary barrier according to claim 1, wherein the isolation device isolates two zones of the portion of the non-vertical wellbore.

3. The secondary barrier according to claim 1, wherein two or more secondary barriers are positioned adjacent to one or more isolation devices in the portion of the non-vertical wellbore.

4. The secondary barrier according to claim 1, wherein the secondary barrier restricts or prevents fluid flow across the secondary barrier.

5. The secondary barrier according to claim 1, wherein the swellable material swells in the presence of a swelling fluid or an increase in temperature.

6. The secondary barrier according to claim 5, wherein the swelling fluid comprises an aqueous liquid or a hydrocarbon liquid.

7. The secondary barrier according to claim 1, wherein the swellable material is a single piece.

8. The secondary barrier according to claim 1, wherein the swellable material is in multiple pieces.

9. The secondary barrier according to claim 8, wherein the multiple pieces are selected from the group consisting of mesoparticles and nanoparticles, and combinations thereof in any proportion.

10. The secondary barrier according to claim 1, wherein the thickness of the enclosure is selected such that the enclosure is capable of being placed into the portion of the non-vertical wellbore.

11. The secondary barrier according to claim 1, wherein the enclosure further comprises a cement.

12. The secondary barrier according to claim 1, wherein the enclosure comprises a tearable enclosure that tears in response to the swelling of the swellable material, wherein the swellable material comprises a cement, and wherein the swellable material has dimensions such that, prior to swelling, the secondary barrier is placed or capable of being placed into the portion of the non-vertical wellbore, and following swelling, the secondary barrier substantially fills an open-hole portion of the wellbore.

13. The secondary barrier according to claim 1, wherein the swellable material comprises a coating that is selected to dissolve in wellbore fluid, and wherein after dissolution of the coating, the swellable material swells at least a sufficient amount such that after swelling, the swellable material has an outer diameter that contacts the entire inner diameter of the portion of the non-vertical wellbore.

14. The secondary barrier according to claim 1, wherein the swellable material swells at least a sufficient amount such that after swelling, the swellable material creates a seal in the portion of the non-vertical wellbore.

15. A secondary barrier for use in conjunction with an isolation device in a portion of a non-vertical wellbore comprising:

a swellable material, wherein the swellable material:

(A) has dimensions such that, prior to swelling, the secondary barrier is capable of being placed into the portion of the non-vertical wellbore, and (B) fills a void within the portion of the non-vertical wellbore to occlude a complete cross-section of the wellbore after the swelling of at least a portion of the swellable material has occurred, wherein the secondary barrier is positioned adjacent to the isolation device in the portion of the non-vertical wellbore, wherein the swellable material is contained within an enclosure, and wherein the enclosure is made from a deformable material, wherein the enclosure has dimensions such that, prior to swelling of the swellable material, the enclosure is capable of being placed into the portion of the non-vertical wellbore, and upon swelling of least a portion of the swellable material, the enclosure returns to a substantially spherical shape to fill an open-hole portion of the wellbore.

16. A method of creating a secondary barrier adjacent to an isolation device in a portion of a non-vertical wellbore comprising:

introducing the secondary barrier into the portion of the non-vertical wellbore, wherein the secondary barrier comprises:

a swellable material, wherein the swellable material:

(A) swells in the presence of a swelling fluid or an increase in temperature, (B) has dimensions such that, prior to swelling, the secondary barrier is capable of being placed into the portion of the non-vertical wellbore, and (C) fills an open-hole portion of the non-vertical wellbore to occlude a complete cross-section of the wellbore after the swelling of at least a portion of the swellable material has occurred, wherein the secondary barrier is positioned adjacent to the isolation device in the portion of the non-vertical wellbore, wherein the swellable material is contained within an enclosure, wherein the enclosure is made from an expandable material, and wherein the enclosure comprises a carrier that is introduced into the non-vertical wellbore, the carrier comprising the swellable material; and contacting or allowing the swellable material to come in contact with the swelling fluid or the increase in temperature, wherein the step of contacting or allowing is performed after the step of introducing the secondary barrier into the portion of the non-vertical wellbore.

17. The method according to claim 16, wherein the step of contacting comprises introducing the swelling fluid or heat into the portion of the non-vertical wellbore.

* * * * *